US006365224B1

(12) United States Patent
Yoshimura et al.

(10) Patent No.: US 6,365,224 B1
(45) **Date of Patent: *Apr. 2, 2002**

(54) PROCESS FOR FORMING METAL LAYER ON SURFACE OF RESIN MOLDED PRODUCT

(75) Inventors: Kohshi Yoshimura, Hyogo; Takeshi Nishiuchi, Osaka; Fumiaki Kikui, Osaka; Shuji Tsujimoto, Osaka, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/558,162

(22) Filed: Apr. 26, 2000

(30) Foreign Application Priority Data

Apr. 28, 1999 (JP) ..... 11-121170

(51) Int. Cl.[7] ..... B05D 1/12
(52) U.S. Cl. ..... 427/180; 427/242
(58) Field of Search ..... 427/127, 242, 427/183, 181, 231, 180; 264/611, DIG. 58; 118/417, 418

(56) References Cited

U.S. PATENT DOCUMENTS 3,093,501 A * 6/1963 Clayton

FOREIGN PATENT DOCUMENTS

| | | |
|---|---|---|
| DE | 853998 | 10/1952 |
| DE | 25 41 235 | 3/1977 |
| EP | 0 406 859 A2 | 1/1991 |
| EP | 0 470 610 A2 | 2/1992 |
| GB | 806677 | 1/1959 |
| GB | 833037 | 4/1960 |
| GB | 879607 | 10/1969 |
| JP | 7-302705 | * 11/1995 |
| JP | 2000-133541 | 5/2000 |

OTHER PUBLICATIONS

"Powder Coating: A Look at Equipment and Materials", by Daniel R. Savage, in "Products Finishing" pp. 40–41, Jan. 1972.*

Database WPI, Section Ch, Week 198828, Derwent Publications Ltd.; London, GB: Class A96, An 1988–194559, XP002142985 & JP 63 132632 Jun. 4, 1988 (Abstract).

Patent Abstracts of Japan, vol. 1996, No. 03, Mar. 29, 1996 & JP 07–302705 A (Daido Sheel Co. LTD.), Nov. 14, 1995 (Abstract).

Patent Abstract of Japan, vol. 013, No. 485 (M–887), Nov. 6, 1989 & JP 01 192514A (Koito MFG Co. LTD), Aug. 2, 1989 (Abstract).

* cited by examiner

*Primary Examiner*—Fred J. Parker
(74) *Attorney, Agent, or Firm*—Armstrong, Westerman & Hattori, LLP

(57) ABSTRACT

A resin molded product and a fine metal powder producing material are placed into a treating vessel. The fine metal powder producing material is brought into flowing contact with the surface of the resin molded product, thereby producing a fine metal powder, and forming a metal layer of the fine metal powder directly on the surface of the resin molded product. In this process, the metal layer of the fine metal powder can be formed firmly and at high density on the surface of the resin molded product. The metal layer exhibits a function as an electrically conductive layer. Therefore, a metal film having an excellent thickness accuracy, an excellent surface smoothness and a high peel strength can be formed in a simple manner on the metal layer by carrying out an electroplating treatment. In addition, it is possible for the metal layer itself to exhibit functions or properties such as an ornamentality.

7 Claims, No Drawings

PROCESS FOR FORMING METAL LAYER ON SURFACE OF RESIN MOLDED PRODUCT

BACKGROUND OF THE INVENTION

1. Field of the Invention

The present invention relates to a process for forming, on the surface of a resin molded product, a metal layer which is useful for forming a metal film. More particularly, the present invention relates to a process for forming, on the surface of a resin molded product, a metal layer of a fine metal powder produced by bringing a metal powder producing material into flowing contact with the surface of the resin molded product in a treating vessel.

2. Description of the Related Art

For the purpose of providing, to a resin molded product, various properties such as an ornamentality, a weather resistance, a surface electrical conductivity, an electromagnetic wave shielding property, an antibacterial property and the like, it is a conventional practice to form a metal film on the surface of the resin molded product. Examples of conventionally known processes for forming a metal film are a vacuum plating process such as a vacuum deposition and a sputtering, an electroless plating process, an electroless plating/electroplating process comprising an electroless plating step and an electroplating step, and the like. These processes have been put into practical use in various fields, because an electroplating process cannot be applied directly to the resin molded product due to the non-electrical conductivity of the resin molded product.

However, the vacuum plating process suffers from problems that a metal film formed by this process has a lower peel strength and a poor durability, that it is difficult to apply this process to a molded product having a complicated shape, that a long time is required for the vacuum processing, because a gas may be generated depending on the type of a resin, and that a production cost is higher.

The electroless plating process suffers from the following problems: It is usually necessary to previously subject the surface of a resin molded product to an etching, or to subject the surface to a catalytic effect providing process such as a sensitizing/activating process. For this reason, the steps are complicated; a long time is required for the processing; and a plated film produced has a small thickness.

In the electroless plating/electroplating process, a metal film formed by this process has a relatively good peel strength, and a durability which is remarkably good, as compared with that of a metal film formed by the vacuum plating process. However, the electroless plating/electroplating process suffers from problems that the steps are complicated, and that a long time is required for the processing.

There is also a proposed metal film forming process comprising a step of applying a resin including a metal powder added thereto to the surface of a resin molded product to provide an electrical conductivity to the surface of it, and an electroplating step. However, this process suffers from a problem that it is generally difficult to provide a resin layer uniformly on the surface of a resin molded product and for this reason, it is impossible due to the ununiformity of the resin layer to form a metal film excellent in thickness accuracy and in surface smoothness.

SUMMARY OF THE INVENTION

Accordingly, it is an object of the present invention to provide a process for forming, on the surface of a resin molded product, a metal layer which is useful for forming a metal film having an excellent thickness accuracy, an excellent surface smoothness and a high peel strength on the surface of the resin molded product in a simple manner.

The present inventors have made various studies to solve the above problems and as a result, they have found that if a fine metal powder producing material is brought into flowing contact with the surface of a resin molded product in a treating vessel, a fine metal powder is produced from the fine metal powder producing material and forms a firm and high-density metal layer on the surface of the resin molded product. It has been further found that the thus-formed metal layer exhibits a function as an electrically conductive layer and hence, a metal film can be formed in a simple manner on the surface of the resin molded product by conducting an electroplating at a subsequent step, and that the metal layer itself exhibits a function of an ornamentality and the like.

The present invention has been accomplished based on such knowledge. To achieve the above object, according to a first aspect and feature of the present invention, there is provided a process for forming a metal layer on the surface of a resin molded product, comprising the steps of placing a resin molded product and a fine metal powder producing material in to a treating vessel, and bringing the fine metal powder producing material into flowing contact with the surface of the resin molded product in the treating vessel, thereby producing a fine metal powder from the fine metal powder producing material, and forming a metal layer of the fine metal powder on the surface of the resin molded product.

According to a second aspect and feature of the present invention, in addition to the first feature, the fine metal powder producing material is brought into flowing contact with the surface of the resin molded product by applying a vibration and/or an agitation to the resin molded product and the fine metal powder producing material.

According to a third aspect and feature of the present invention, in addition to the first feature, the treating vessel is a treating chamber in a barrel finishing machine.

According to a fourth aspect and feature of the present invention, in addition to the first feature, the processing is carried out in a dry manner.

According to a fifth aspect and feature of the present invention, in addition to the first feature, the fine metal powder producing material is a material for producing a fine powder of at least one metal selected from the group consisting of Cu, Sn, Zn, Pb, Cd, In, Au, Ag, Fe, Ni, Co, Cr and Al.

According to a sixth aspect and feature of the present invention, in addition to the first feature, the surface of the resin is previously roughened at a pre-step.

According to a seventh aspect and feature of the present invention, there is provided a process for forming a metal film on the surface of a resin molded product, comprising the steps of forming a metal layer on the surface of a resin molded product according to any of the first to sixth features, and forming a metal film on the metal layer.

According to an eighth aspect and feature of the present invention, in addition to the seventh feature, the metal film is formed by an electroplating treatment or an electroless plating treatment.

According to a ninth aspect and feature of the present invention, there is provided a resin molded product which has a metal layer of a fine metal powder on the surface thereof.

According to a tenth aspect and feature of the present invention, there is provided a resin molded product which has a metal layer of a fine metal powder formed on the surface thereof, and a metal film formed on the metal layer.

With the process for forming a metal layer according to the present invention, a metal layer of a fine metal powder can be formed at a firmly and a high density on the surface of the resin molded product. The metal layer exhibits a function as an electrically conductive layer and hence, a metal film having an excellent thickness accuracy, an excellent surface smoothness and a high peel strength can be formed in a simple manner on the metal layer by conducting an electroplating treatment. In addition, it is possible for the metal layer itself to exhibit a function of an ornamentality and the like.

DETAILED DESCRIPTION OF THE INVENTION

The process for forming a metal layer on a resin molded product according to the present invention comprises the steps of placing a resin molded product and a fine metal powder producing material into a treating vessel, and bringing the fine metal powder producing material into flowing contact with the surface of the resin molded product in the treating vessel, thereby producing a fine metal powder from the fine metal powder producing material, and forming a metal layer of the fine metal powder on the surface of the resin molded product. Therefore, the shape of the resin molded product is particularly not limited, if it is such that the fine metal powder producing material can flow on the surface of the resin molded product.

The present invention is directed to the process for forming the metal layer on the surface of the resin molded product. Therefore, the term "resin molded product" used in the present invention means to include, in addition to a molded product formed of a resin in the whole, a molded product, only the surface of which is formed of a resin, a molded product which includes a forming component other than a resin in the inside thereof, but the surface of which is formed substantially of a resin (e.g., a bonded magnet, the inside of which is formed of both of a magnetic powder and a resin, and the surface of which is formed substantially of a resin) and the like.

Examples of the resins forming the resin molded product are an epoxy resin, a polyvinyl chloride resin, an acrylic resin, a silicone rubber, a fluorine resin such as TEFLON®, an ABS resin (acrylonitrile-butadiene-styrene terpolymer resin), a polyolefin resin such as polyethylene and polypropylene, a phenol resin, a polycarbonate, a polyester resin such as polyethylene terephthalate and polybutylene terephthalate, a polyimide resin, FRP (fiber-reinforced plastics), a polyamide resin such as nylons, a thermoplastic elastomer such as a polyester elastomer and the like.

Examples of the fine metal powder producing materials for producing the fine metal powder are materials for producing a fine powder of at least one metal selected from the group consisting of Cu, Sn, Zn, Pb, Cd, In, Au, Ag, Fe, Ni, Co, cr and Al. The fine metal powder producing material may be also a material of an alloy containing any of the above-described metals. A plurality of fine metal powder producing materials may be used in combination, so that a metal layer of a desired fine alloy powder derived from such fine metal powder producing materials is formed on the resin molded product (For example, a metal layer of a fine Pb-Sn alloy powder can be formed on the surface of the resin molded product by using a combination of a fine Pb-powder producing material and a fine Sn-powder producing material. The resin molded product having such metal layer can be utilized as an electric contact element in IC). The fine metal powder producing material may contain impurities inevitable in the industrial production.

The fine metal powder producing material may comprise metal pieces made of only a desired metal, composite metal pieces each comprising a desired metal coated on a core material made of a different metal, and the like. The pieces may be of any of various shapes such as a needle-like shape (a wire-like shape), a columnar shape, a massive shape and the like. From the viewpoint of producing a fine metal powder efficiently, it is desirable to use metal pieces each with a sharp end, for example, a metal piece having a needle-like shape and a metal piece having a columnar shape. Such a desirable shape can be easily provided by employing a known wire cutting technique.

From the viewpoint of producing a fine metal powder efficiently, the size (longer diameter) of the pieces of the fine metal powder producing material is desirably in a range of 0.05 mm to 10 mm, more desirably in a range of 0.3 mm to 5 mm, and further desirably in a range of 0.5 mm to 3 mm. The fine metal powder producing material comprising pieces having the same shape and the same size may be used, or the fine metal powder producing material comprising pieces having different shapes and different sizes may be used in the form of a mixture.

From the viewpoint of producing a fine metal powder efficiently and the viewpoint of forming a metal layer of the fine metal powder produced from the fine metal powder producing material efficiently, it is desirable that the method for bringing the fine metal powder producing material into flowing contact with the surface of the resin molded product is a method which comprises applying a vibration and/or an agitation to the resin molded product and the fine metal powder producing material. Such method can be carried out, for example, using a treating chamber in a barrel finishing machine or a ball mill apparatus. The barrel finishing machine may be of a known type such as a rotated-type, a vibrated-type, a centrifugal-type and the like. In the case of the rotated-type, it is desirable that the rotational speed is in a range of 20 rpm to 50 rpm. In the case of the vibrated-type, it is desirable that the vibration frequency is in a range of 50 Hz to 100 Hz, and the vibration amplitude is in a range of 0.3 mm to 10 mm. In the case of the centrifugal-type, it is desirable that the rotational speed is in a range of 70 rpm to 200 rpm.

The total amount of resin molded product and fine metal powder producing material thrown into the treating vessel is desirable to be in a range of 20% by volume to 90% by volume of the internal volume of the treating vessel. If the total amount is lower than 20% by volume of the internal volume of the treating vessel, the throughput is too small, which is not preferred in practical use. On the other hand, if the total amount exceeds 90% by volume of the internal volume of the treating vessel, there is a possibility that the formation of the metal layer on the surface of the resin molded product does not occur efficiently. The ratio of the resin molded product to the fine metal powder producing material thrown into the treating vessel is desirable to be 3 or less in terms of the volume ratio (of resin molded product/fine metal powder producing material). If the volume ratio exceeds 3, there is a possibility that a long time is required for the formation of the metal layer, which is not preferred in practical use.

The treating time depends on the throughput, but is generally in a range of about 1 hour to about 10 hours.

It is desirable that the flowing contact of the fine metal powder producing material with the surface of the resin molded product is conducted in a dry manner in consideration of a case where the fine metal powder producing material is liable to be corroded by oxidation.

The particle size (longer particle diameter) of the fine metal powder produced from the fine metal powder producing material by the flowing contact of the fine metal powder producing material with the surface of the resin molded product is in a range of generally 0.001 μm to generally 5 μm, and the particles of the fine metal powder are of various shapes. The particles of the produced fine metal powder are allowed to collide against the contents (many of which are the pieces of the fine metal powder producing material) of the treating vessel on the surface of the resin molded product, whereby tip ends of the particles are impaled and forced into the surface of the resin molded product, and portions of the particles protruding on the surface of the resin molded product are deformed (e.g., spread) to cover the surface. This serves as a start for the formation of the metal layer and thereafter, the fine metal particles laminated on the fine metal particles forced into the surface of the resin molded product, particles resulting from the deformation of the particles laminated, aggregates of fine metal particles, masses resulting from the deformation of the aggregates (e.g., scale-shaped masses resulting from the spreading of the aggregates), laminates of the aggregates and the like, contribute to the formation of the metal layer, and all of them form the metal layer. Therefore, it should be understood that the term "metal layer of the fine metal powder" used in the present invention means a metal layer formed from a forming source provided by the fine metal powder produced from the fine metal powder producing material.

For the purpose of assisting the fine metal powder in being forced into the surface of the resin molded product at an initial stage of the formation of the metal layer, the surface of the resin molded product may be previously roughened using an emery abrasive at a pre-step.

The metal layer formed of the fine metal powder in the above manner exhibits a function as an electrically conductive layer and hence, it is possible to conduct an electroplating on the metal layer, thereby forming a metal film having an excellent thickness accuracy and an excellent surface smoothness on the surface of the resin molded product. Further, the metal layer has an anchoring effect, because it is formed basically from the fine metal powder forced into the surface of the resin molded product. Therefore, the metal film formed on the metal layer has a feature of a high peel strength. Further, there is an advantage that an electroless plating treatment can be carried out on the metal layer without an etching treatment and a catalytic effect providing treatment.

In addition, the metal layer of the fine metal powder according to the present invention is formed firmly and at a high density on the surface of the resin molded product. Therefore, the metal layer itself can exhibit properties such as a corrosion resistance, a wettability, a light shielding property and the like, in addition to conventionally desired properties such as an ornamentality and the like by properly selecting a material for the fine metal powder produced from the fine metal powder producing material. Additionally, the metal layer can exhibit a plurality of functions or properties by forming the metal layer in a laminated manner. It is of course that if a high performance is demanded, it is necessary to carry out a further electroplating treatment to form a metal film. From the viewpoint of easily providing given functions or properties to the resin molded product, however, it is very advantageous that the metal layer itself can exhibit various functions or properties.

EXAMPLES

Example 1

The following processing was carried out using a 3 cm square block made of an epoxy resin as a sample. First, the surface of the sample was roughened by polishing using an emery abrasive of a count of 280. Then, the ten samples (having an apparent volume of 0.27 liters) having the roughened surface and a fine Cu-powder producing material (having an apparent volume of 2 liters) of short columnar pieces (made by cutting a wire) having a diameter of 2 mm and a length of 2 mm were thrown into a treating chamber in a vibrated-type barrel finishing machine having a volume of 2.8 liters (so that the total amount was of 81% by volume of the internal volume of the treating chamber) where they were treated in a dry manner for 4 hours under conditions of a vibration frequency of 60 Hz and a vibration amplitude of 1.5 mm.

A fine Cu powder produced by this operation contained smallest particles having a longer diameter equal to or smaller than 0.1 μm, and largest particles having a longer diameter of about 5 μm.

The surface of each of the samples treated was observed by an optical microscope (having a magnification of 100) and as a result, it was found that a metal layer of the fine Cu powder could be formed uniformly on the entire surface of the sample.

Example 2

Each of the samples produced in Example 1 and having the metal layer of the fine Cu powder on the entire surface was subjected to a ultrasonic washing for 1 minute and then to an Ni-electroplating treatment in a rack manner using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2 A/dm$^2$, a plating time of 60 minutes, a pH value of 4.2 and a bath temperature of 55° C. As a result, a plated film having a thickness of 15 μm could be formed on the metal layer made of the fine Cu powder.

Example 3

The following processing was carried out using a 3 cm square block made of an epoxy resin as a sample. The ten samples (having an apparent volume of 0.27 liters) and a fine Al-powder producing material (having an apparent volume of 2 liters) of short columnar pieces (made by cutting a wire) having a diameter of 1 mm and a length of 1 mm were thrown into a treating chamber in a vibrated-type barrel finishing machine having a volume of 2.8 liters (so that the total amount was of 81% by volume of the internal volume of the treating chamber), where they were treated in a dry manner for 4 hours under conditions of a vibration frequency of 60 Hz and a vibration amplitude of 1.5 mm.

A fine Al powder produced by this operation contained smallest particles having a longer diameter equal to or smaller than 0.1 μm, and largest particles having a longer diameter of about 5 μm.

The surface of each of the samples treated was observed by an optical microscope (having a magnification of 100) and as a result, it was found that a metal layer of the fine Al powder could be formed uniformly on the entire surface of the sample.

Example 4

Each of the samples produced in Example 3 and having the metal layer of the fine Al powder on the entire surface was subjected to a ultrasonic washing for 1 minute and then immersed in a zincifying solution (having a composition comprising 50 g/l of sodium hydroxide, 5 g /1 of zinc oxide, 2 g/l of ferric chloride, 50 g/l of Rochelle salt and 1 g/l of sodium nitrate) under a condition of a bath temperature of 20° C. for 1 minute to carry out the zincifying treatment. Then, each of the samples was washed and subjected to an Ni-electroplating treatment in a rack manner using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2 A/dm$^2$, a plating time of 60 minutes, a pH value of 4.2 and a bath temperature of 55° C. As a result, a plated film having a thickness of 16 $\mu$m could be formed on the metal layer made of the fine Al powder.

Example 5

Each of the samples produced in Example 1 and having the metal layer of the fine Cu powder on the entire surface was subjected to a ultrasonic washing for 1 minute and then to an electroless Cu-plating treatment using an electroless Cu-plating solution (THRUCUP ELC-SP made by Uemura Industries, Co.) under conditions of a plating time of 30 minutes and a bath temperature of 60° C. As a result, a plated film having a thickness of 2 $\mu$m could be formed on the metal layer made of the fine Cu powder.

Example 6

The processing was carried out in the same manner as in Example 1, except that the 3 cm square block made of the epoxy resin used in Example 1 was replaced by a 3 cm square block made of a polyvinyl chloride resin. As a result, a metal layer of a fine Cu powder could be formed uniformly on the entire surface of the block.

Example 7

The processing was carried out in the same manner as in Example 1, except that the 3 cm square block made of the epoxy resin used in Example 1 was replaced by a 3 cm square block made of an acrylic resin. As a result, a metal layer of a fine Cu powder could be formed uniformly on the entire surface of the block.

Example 8

The processing was carried out in the same manner as in Example 1, except that the 3 cm square block made of the epoxy resin used in Example 1 was replaced by a 3 cm square block made of a silicone rubber. As a result, a metal layer of a fine Cu powder could be formed uniformly on the entire surface of the block.

Example 9

The processing was carried out in the same manner as in Example 1, except that the 3 cm square block made of the epoxy resin used in Example 1 was replaced by a 3 cm square block made of TEFLON®. As a result, a metal layer of a fine Cu powder could be formed uniformly on the entire surface of the block.

Example 10

The processing was carried out in the same manner as in Example 3, except that the 3 cm square block made of the epoxy resin used in Example 3 was replaced by a 3 cm square block made of a polyvinyl chloride resin. As a result, a metal layer of a fine Al powder could be formed uniformly on the entire surface of the block.

Example 11

The processing was carried out in the same manner as in Example 3, except that the 3 cm square block made of the epoxy resin used in Example 3 was replaced by a 3 cm square block made of an acrylic resin. As a result, a metal layer of a fine Al powder could be formed uniformly on the entire surface of the block.

Example 12

The processing was carried out in the same manner as in Example 3, except that the 3 cm square block made of the epoxy resin used in Example 3 was replaced by a 3 cm square block made of a silicone rubber. As a result, a metal layer of a fine Al powder could be formed uniformly on the entire surface of the block.

Example 13

The processing was carried out in the same manner as in Example 3, except that the 3 cm square block made of the epoxy resin used in Example 3 was replaced by a 3 cm square block made of Teflon®. As a result, a metal layer of a fine Al powder could be formed uniformly on the entire surface of the block.

Example 14

70% By volume of a strontium ferrite powder having an average particle size of 1.22 $\mu$m and 30% by volume of a polyester elastomer were mixed in a Henschel mixer and then, the mixture was subjected to a molding in a twin-screw extruder, thereby producing a bonded magnet having a size of 10 mm×10 mm×100 mm and having a surface formed substantially of the polyester elastomer. The surface of the bonded magnet was roughened by polishing using an emery abrasive having a count of 280. Then, the 20 bonded magnets (having an apparent volume of 0.2 liters) having the roughened surface and a fine Cu-powder producing material (having an apparent volume of 2 liters) of short columnar pieces (made by cutting a wire) having a diameter of 2 mm and a length of 2 mm were thrown into a treating chamber in a vibrated-type barrel finishing machine having a volume of 2.8 liters (so that the total amount was of 79% by volume of the internal volume of the treating chamber), where they were treated in a dry manner for 4 hours under conditions of a vibration frequency of 60 Hz and a vibration amplitude of 1.5 mm.

A fine Cu powder produced by this operation contained smallest particles having a longer diameter equal to or smaller than 0.1 $\mu$m, and largest particles having a longer diameter of about 5 $\mu$m.

The surface of each of the bonded magnets was observed by an optical microscope (having a magnification of 100) and as a result, it was found that a metal layer of the fine Cu powder could be formed uniformly on the entire surface of the bonded magnet.

Example 15

Each of the bonded magnets produced in Example 14 and having the metal layer of the fine Cu powder on the entire surface was subjected to an Ni-electroplating treatment under the same conditions as in Example 2. As a result, a plated film having a thickness of 13 μm could be formed on the metal layer made of the fine Cu powder.

The metal layer made of the fine Cu powder formed on the entire surface of the bonded magnet having the surface formed substantially of the polyester elastomer in the above manner is useful as a primary coat layer for an electroplating treatment of the bonded magnet. An effect of enhancing the mechanical strength of the magnet (preventing the cracking and breaking) was provided by forming a plated film on the surface of the metal layer by an electroplating treatment, whereby the generation of a magnetic fine powder due to the cracking and breaking of the magnet could be prevented.

Example 16

65% By volume of MQP-B (which is a trade name and made by MQI, Co.) made by pulverization of a rapid solidified thin band of an R—Fe—B based alloy and 35% by volume of nylon-12 were mixed in a Henschel mixer and then, the mixture was subjected to a molding in an injection molding machine, thereby producing a bonded magnet having a size of 10 mm×10 mm×10 mm and having a surface formed substantially of the nylon-12. The surface of the bonded magnet was roughened by polishing using an emery abrasive having a count of 280. Then, the 100 bonded magnets (having an apparent volume of 0.1 liter) having the roughened surface and a fine Cu-powder producing material (having an apparent volume of 2 liters) of short columnar pieces (made by cutting a wire) having a diameter of 2 mm and a length of 2 mm were thrown into a treating chamber in a vibrated-type barrel finishing machine having a volume of 2.8 liters (so that the total amount was of 75% by volume of the internal volume of the treating chamber), where they were treated in a dry manner for 4 hours under conditions of a vibration frequency of 60 Hz and a vibration amplitude of 1.5 mm.

A fine Cu powder produced by this operation contained smallest particles having a longer diameter equal to or smaller than 0.1 μm, and largest particles having a longer diameter of about 5 μm.

The surface of each of the bonded magnets was observed by an optical microscope (having a magnification of 100) and as a result, it was found that a metal layer of the fine Cu powder could be formed uniformly on the entire surface of the bonded magnet.

Example 17

Each of the bonded magnets produced in Example 16 and having the metal layer of the fine Cu powder on the entire surface was subjected to an Ni-electroplating treatment under the same conditions as in Example 2. As a result, a plated film having a thickness of 14 μm could be formed on the metal layer made of the fine Cu powder.

The metal layer made of the fine Cu powder formed on the entire surface of the bonded magnet having the surface formed substantially of the nylon-12 in the above manner is useful as a primary coat layer for an electroplating treatment of the bonded magnet. An effect of enhancing the weather resistance and the mechanical strength of the magnet (preventing the cracking and breaking) could be provided by forming a plated film on the surface of the metal layer by an electroplating treatment.

Example 18

The processing was carried out in the same manner as in Example 1, except that the 3 cm square block made of the epoxy resin used in Example 1 was replaced by a 3 cm square block made of FRP (a fiber-reinforced plastics). As a result, a metal layer of a fine Cu powder could be formed uniformly on the entire surface of the block.

Example 19

The following processing was carried out using a 3 cm square block made of an epoxy resin as a sample. First, the surface of the sample was roughened by polishing using an emery abrasive of a count of 280. Then, the ten samples (having an apparent volume of 0.27 liters) having the roughened surface and a fine Ni-powder producing material (having an apparent volume of 2 liters) of short columnar pieces (made by cutting a wire) having a diameter of 2 mm and a length of 2 mm were thrown into a treating chamber in a vibrated-type barrel finishing machine having a volume of 2.8 liters (so that the total amount was of 81% by volume of the internal volume of the treating chamber), where they were treated in a dry manner for 4 hours under conditions of a vibration frequency of 60 Hz and a vibration amplitude of 1.5 mm.

A fine Ni powder produced by this operation contained smallest particles having a longer diameter equal to or smaller than 0.1 μm, and largest particles having a longer diameter of about 5 μm.

The surface of each of the samples treated was observed by an optical microscope (having a magnification of 100) and as a result, it was found that a metal layer of the fine Ni powder could be formed uniformly on the entire surface of the sample.

Example 20

Each of the samples produced in Example 19 and having the metal layer of the fine Ni powder on the entire surface was subjected to a ultrasonic washing for 1 minute and then to an electroless Ni-plating treatment using an electroless Ni-plating solution (NIMUDEN SX made by Uemura Industries, Co.) under conditions of a plating time of 30 minutes and a bath temperature of 90° C. As a result, a plated film having a thickness of 4 μm could be formed on the metal layer made of the fine Ni powder. Then, the resulting sample was subjected to an Ni-electroplating treatment under the same conditions as in Example 2, and as a result, a plated film having a thickness of 15 μm could be formed in a laminated manner.

What is claimed is:

1. A process for forming a metal layer on the surface of a resin molded product, comprising the steps of placing a resin molded product and a fine metal powder producing material into a treating vessel, and bringing said fine metal powder producing material into flowing contact with the surface of said resin molded product in said treating vessel, thereby producing from said fine metal powder producing material a fine metal powder having a smaller particle size than said fine metal powder producing material, and the produced fine metal powder forms a metal layer directly on the surface of said resin molded product.

2. A process for forming a metal layer according to claim 1, wherein said treating vessel is a treating chamber in a barrel finishing machine.

3. A process for forming a metal layer according to claim 1, wherein the processing is carried out in a dry manner.

4. A process for forming a metal layer according to claim 1, wherein said fine metal powder producing material is a material for producing a fine powder of at least one metal selected from the group consisting of Cu, Sn, Zn, Pb, Cd, In, Au, Ag, Fe, Ni, Co, Cr and Al.

5. A process for forming a metal layer according to claim 1, wherein the surface of the resin molded product is first roughened in a pre-treatment step.

6. A process for forming a metal film on the surface of a resin molded product, comprising the steps of forming a metal layer on the surface of a resin molded product according to any of claims 1 or 2–5, and forming a metal film on said metal layer.

7. A process for forming a metal film according to claim 6, wherein said metal film is formed by an electroplating treatment or an electroless plating treatment.

* * * * *